US005415114A

United States Patent [19]

Monro et al.

[11] Patent Number: 5,415,114

[45] Date of Patent: May 16, 1995

[54] INTERNAL AIR AND/OR FUEL STAGED CONTROLLER

[75] Inventors: Richard J. Monro, Ridgefield; R. Gifford Broderick, Wilton, both of Conn.

[73] Assignee: RJC Corporation, Ridgefield, Conn.

[21] Appl. No.: 114,230

[22] Filed: Oct. 27, 1993

[51] Int. Cl.[6] ..... F23D 1/00

[52] U.S. Cl. ..... 110/347; 110/264; 431/9; 431/184

[58] Field of Search ..... 110/347, 264; 431/182, 431/183, 184, 8, 9

[56] References Cited

U.S. PATENT DOCUMENTS

| | | |
|---|---|---|
| 988,271 | 3/1911 | Lee . |
| 1,086,714 | 2/1914 | Irish . |
| 1,647,675 | 11/1927 | Vedder . |
| 1,710,726 | 4/1929 | Eickworth . |
| 2,320,576 | 6/1943 | Dunn . |
| 2,439,554 | 4/1948 | Anderson . |
| 3,788,796 | 1/1974 | Krippene et al. . |
| 4,147,116 | 4/1979 | Graybill . |
| 4,249,470 | 2/1981 | Vatsky . |
| 4,270,895 | 6/1981 | Vatsky . |
| 4,297,093 | 10/1981 | Morimoto . |
| 4,333,405 | 6/1982 | Michelfelder et al. . |
| 4,353,688 | 10/1982 | Ahner . |
| 4,381,718 | 5/1983 | Carver . |
| 4,422,391 | 12/1983 | Izuha . |
| 4,426,939 | 1/1984 | Winship . |
| 4,457,241 | 7/1984 | Itse et al. . |
| 4,466,363 | 8/1984 | Leikert et al. . |
| 4,475,472 | 10/1984 | Adrian et al. . |
| 4,479,442 | 10/1984 | Itse et al. . |
| 4,497,263 | 2/1985 | Vatsky . |
| 4,515,094 | 5/1985 | Azuhata et al. . |
| 4,523,530 | 6/1985 | Kaminaka . |
| 4,532,873 | 8/1985 | Rivers et al. . |
| 4,545,307 | 10/1985 | Morita et al. . |
| 4,569,295 | 2/1986 | Skoog . |
| 4,614,159 | 9/1986 | Sugiura et al. . |
| 4,626,204 | 12/1986 | Saint Julian et al. . |
| 4,654,001 | 3/1987 | LaRue . |
| 4,681,532 | 7/1987 | Chung . |
| 4,690,074 | 9/1987 | Norton . |
| 4,702,180 | 10/1987 | Kiga . |
| 4,732,093 | 3/1988 | Hansen . |
| 4,741,279 | 5/1988 | Azuhata et al. . |
| 4,768,446 | 9/1988 | Wilkes et al. . |
| 4,776,289 | 10/1988 | Peter-Hoblyn et al. . |
| 4,790,743 | 12/1988 | Leikert . |
| 4,902,221 | 2/1990 | Collins, Jr. et al. . |
| 4,930,430 | 6/1990 | Allen et al. . |
| 5,131,334 | 7/1992 | Monro . |

*Primary Examiner*—Denise L. Gromada

*Attorney, Agent, or Firm*—St. Onge Steward Johnston & Reens

[57] ABSTRACT

A burner flame stabilizer which circumferentially stages the air to form circumferentially-spaced fuel rich and fuel lean zones for lowering of $NO_x$ is described. A circumferential solid fuel stager is described, which operates with a fuel stabilizer to provide increased dwell time for coal particles volatilization in a recirculation zone established by the flame stabilizer. Various embodiments are described.

25 Claims, 7 Drawing Sheets

FIG. 9
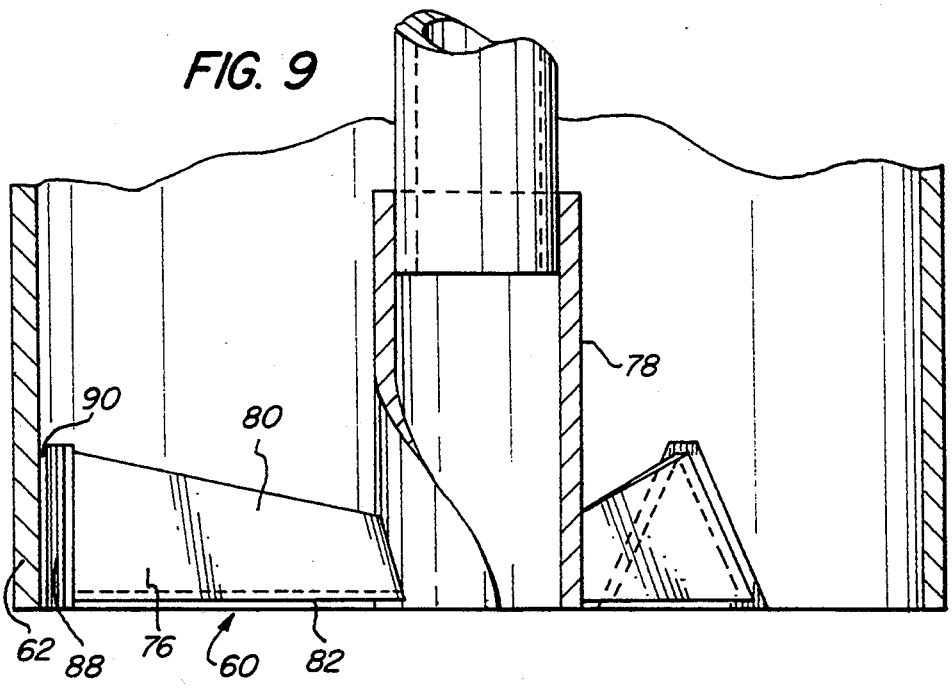
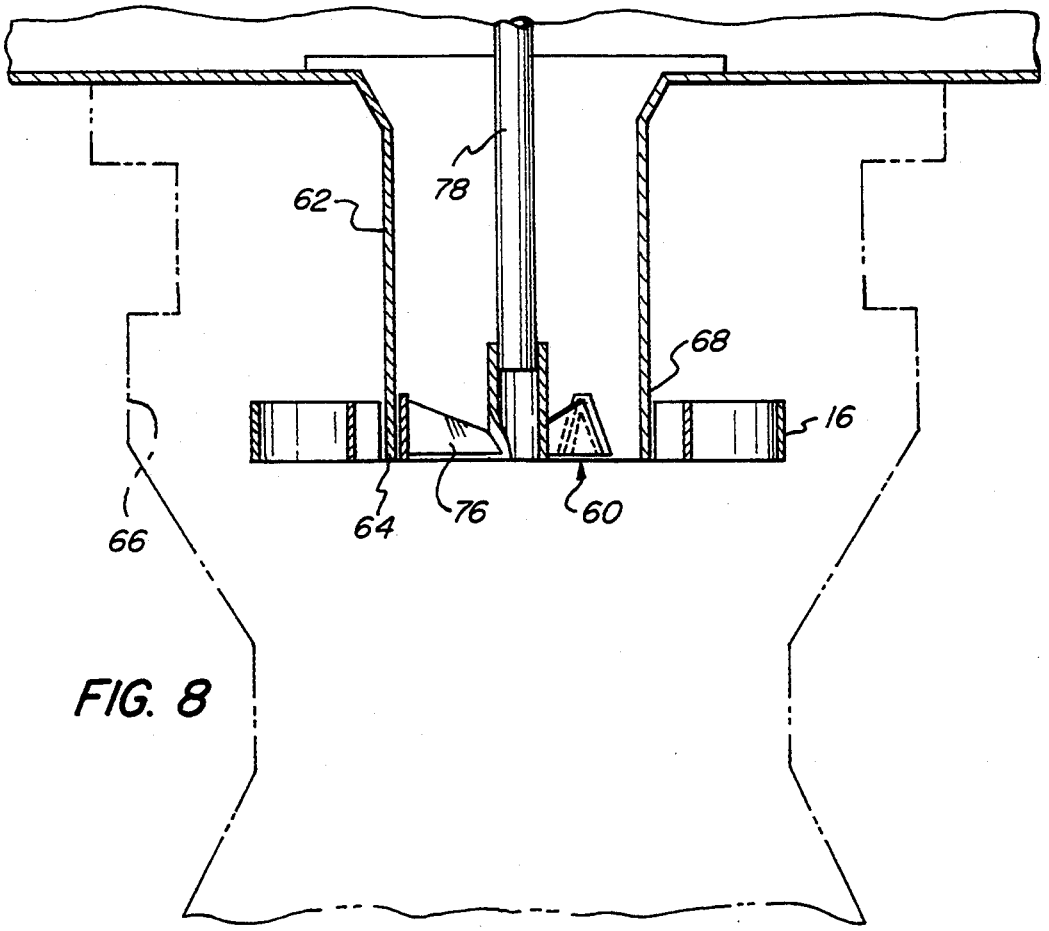
FIG. 8

INTERNAL AIR AND/OR FUEL STAGED CONTROLLER

FIELD OF THE INVENTION

This invention relates to hydrocarbon burners generally and more specifically to a controller for a burner having staged zones to reduce flame temperatures for $NO_x$ reduction.

BACKGROUND OF THE INVENTION

Solid fuel burners using pulverized coal, are well known in the art, see for example U.S. Pat. Nos. 988,271, 1,086,714, and 1,647,675. The '714 patent describes a shaping of a burner in such manner that its throat permits a larger amount of secondary air above and below the flame region than to the sides so as to shape the flame into a flatter form.

U.S. Pat. No. 4,297,093 describes a $NO_x$ reduction burner with which a fuel lean zone surrounds an inner fuel rich zone. A staging of combustion air in a burner to reduce $NO_x$ is described in U.S. Pat. Nos. 4,381,718, 4,422,391, and 4,426,939. In U.S. Pat. No. 4,654,001, $NO_x$ reduction is claimed for a coal burner by generating an outer fuel rich stream which surrounds an inner fuel lean stream. Multiple staging in a burner is described in U.S. Pat. No. 4,790,743.

SUMMARY OF THE INVENTION

With a controller for a burner in accordance with the invention, staging in the combustion of the fuel is achieved in a manner whereby fuel rich and fuel lean zones are circumferentially-distributed around the central flame ignition zone in a manner whereby enhanced control over the flammability of the various zones is achieved with appropriate $NO_x$ reduction.

This is obtained in accordance with one controller for a burner in accordance with the invention by employing a flame stabilizer that is mounted around a central fuel feed tube. Typically, the fuel is a solid pulverized fuel which is supplied with primary air to an inner ignition zone downstream of a discharge end of the fuel feed tube.

The flame stabilizer has a plurality of vanes shaped and oriented to provide a desired swirl number in a manner either as described in U.S. Pat. No. 5,131,334, which, therefore, is incorporated herein by reference thereto or in a manner as shown in a copending patent application entitled, Flame Stabilizer For Solid Fuel Burner, Ser. No. 07/909,042 and filed on Jul. 6, 1992 and whose vanes are illustrated in the drawings of this application. This application is also incorporated herein by reference thereto.

In one flame stabilizer in accordance with this invention, multiple staging is achieved in a circumferentially-controlled manner by providing circumferential variations in restrictions interposed in the secondary air flow around the central fuel feed tube. As described herein for one form of the invention, certain circumferential segments are provided with a larger concentration of vanes or the spacings between successive vanes is reduced. This results in a reduction of secondary air flow through these segments and causes fuel rich zones downstream of these segments. In other circumferential portions, a larger amount of secondary air is passed to thus produce fuel lean zones downstream of these portions.

In such manner, circumferentially-alternating zones of fuel rich and fuel lean zones can be created around a central stabilized ignition zone. The flammability of these respective zones can be controlled closer to the flammability limits and a significant $NO_x$ reduction can be achieved. Because the air mass flows across the fuel rich staged zones are reduced in comparison to the fuel lean staged zones, the momentum of the solid fuel particles provides much better penetration in these zones. As a result, there is an enhancement in the creation of the fuel rich mixtures needed for low $NO_x$ control.

In another technique in accordance with the invention for reducing $NO_x$, circumferential lean and rich fuel zones are produced by separating fuel flow in circumferentially-spaced zones. This is done in a coal burner in accordance with the invention by placing a circumferentially-shaped fuel separator directly in the path of a central coal particle fuel stream. The separator as described for one embodiment is formed with a plurality of vanes arranged in pairs that extend radially out from a central support. Upstream edges of the vanes converge towards each other while downstream-located edges diverge and are sloped towards the inner part of the feed tube. With such flow separator, fuel flow is diverted to the sides to produce circumferentially-spaced fuel rich zones while fuel lean zones are produced generally downstream of the pairs of vanes.

With the diverging downstream edges the profile of the fuel flow separator, as seen along the axis of the fuel feed tube, a significant portion of the fuel feed tube's cross section is affected. Coal particles, which tend to concentrate towards the outer periphery of the fuel feed tube are redirected towards the inner part of the tube's discharge end by upwardly sloping vanes. The coal particles then can enter a recirculation zone such as produced by the aforementioned flame stabilizer, or such other swirler as seems appropriate, at a region where the dwell time within this zone can be longer.

In another embodiment, vanes are used in an inclined orientation and positioned to intercept solid fuel flow along angularly-spaced regions and deflect the intercept solid fuel flow into fuel rich zones which are more centrally located.

The recirculation zone is characterized by high temperatures in an oxygen deficient atmosphere. Within such zone, the coal particles can volatilize rapidly. As the volatiles emerge from or reach the outer part of the recirculation zone, there is a sufficient amount of oxygen to complete the burning process, but with a significantly lower amount of $NO_x$ being created from high temperature combustion.

It is, therefore, an object of the invention to provide a method and apparatus for enhanced staging of combustion air and/or fuel for a burner to achieve fuel mixtures that enable $NO_x$ reduction. It is a further object of the invention to provide a flame stabilizer with which a desired air staging for a burner can be obtained for $NO_x$ reduction.

These and other objects and advantages of the invention can be understood from the following detailed description of the drawings.

BRIEF DESCRIPTION OF DRAWINGS

FIG. 8 is a top section view of a solid fuel burner using a circumferential solid fuel separator in accordance with the invention;

FIG. 9 is an enlarged top section view of the circumferential solid fuel separator shown in FIG. 8;

DETAILED DESCRIPTION OF THE DRAWINGS

Figure 2:
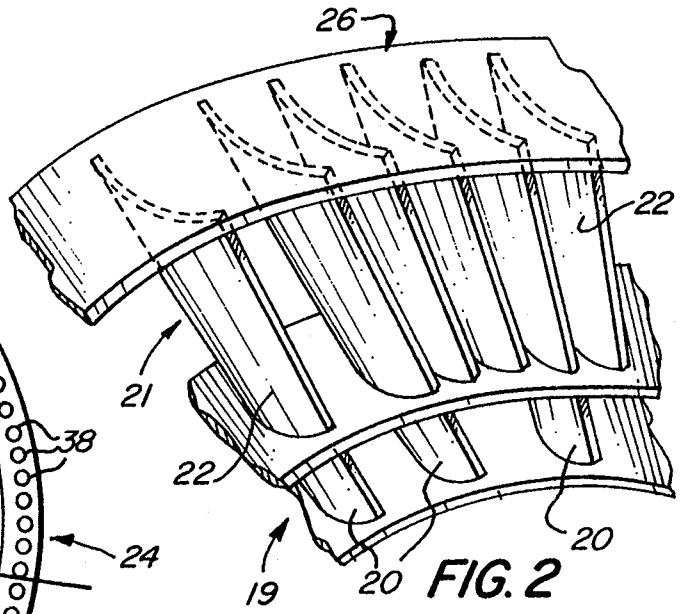
FIG. 2 is a perspective view of a portion of the flame stabilizer shown in FIG. 1.
Figure 3:
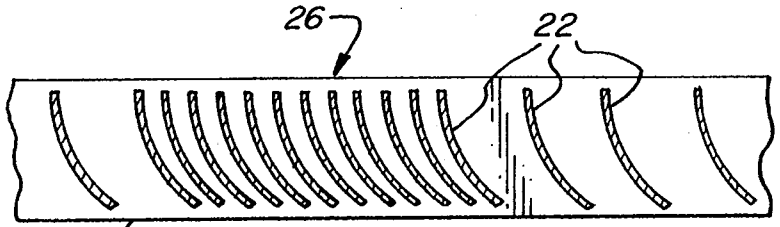
FIG. 3 is a section view taken along the arcuate line 3—3 in FIG. 1.
Figure 1:
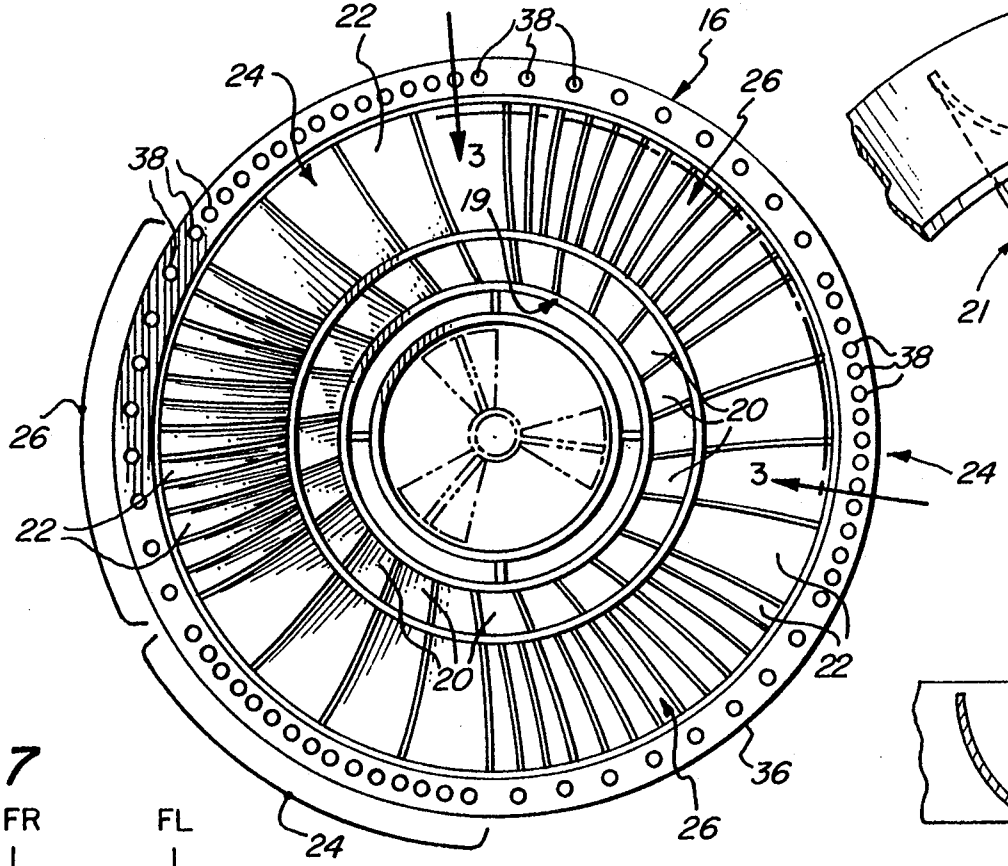
FIG. 1 is an axial front upstream view of one burner using a flame stabilizer in accordance with the invention.

With reference to FIGS. 1–4, a burner 10 of this invention is shown formed with a central solid fuel feed tube 12 which terminates at or in the vicinity of a throat 14 through which secondary air 17 is supplied to the flame region downstream of throat 14. A flame stabilizer 16 is employed around the tube 12. The flame stabilizer may be mounted around the discharge end 18 or be set further upstream as appears appropriate for the particular air flow dynamics. Ignition devices and other accessories, if necessary, have been deleted for clarity.

Figure 5:
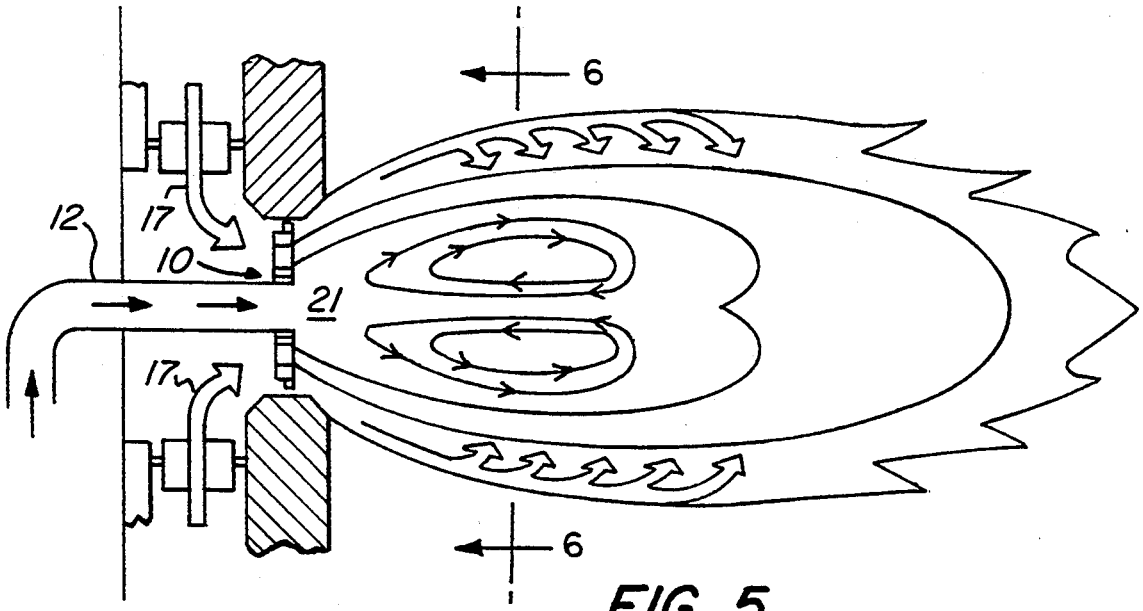
FIG. 5 is a reduced side section view in elevation of a burner in accordance with the invention and its operation.

The flame stabilizer 16 includes an inner zone ring 19 of vanes 20 shaped to control a flame ignition region 21 (see FIGS. 5, 6) and stabilize it downstream of the discharge end 18. The shape of the vanes and their size are selected to impart a desired swirl, generally as described in the aforementioned U.S. Pat. No. 5,131,344 or in case of an initially excessive swirling of secondary air, vanes 20 can be shaped as described in the aforementioned copending patent application.

Radially outward of the ring of vanes 20 is a ring 21 of a plurality of like-shaped vanes 22, such as shown and described in the copending patent application. These vanes 22 are distributed in such quantity as to create sparse regions 24 where the vanes 22 are spaced to pass more secondary air and restricted regions 26 where the vanes 22 are more closely spaced to reduce mass flow of secondary air.

Figure 6:
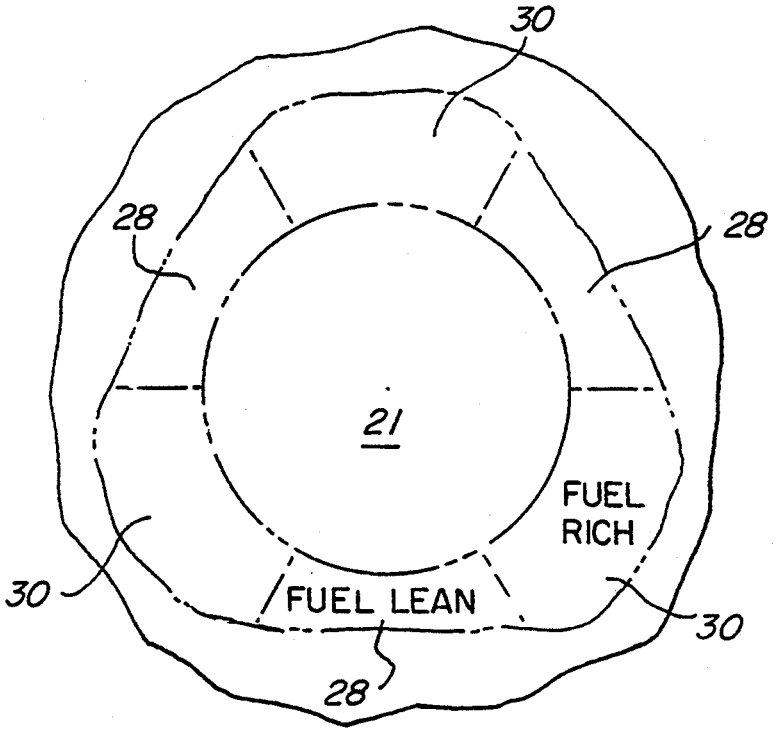
FIG. 6 is a partial sectional schematic representation of the flame region taken along the line 6—6 in FIG. 5.
Figure 11:
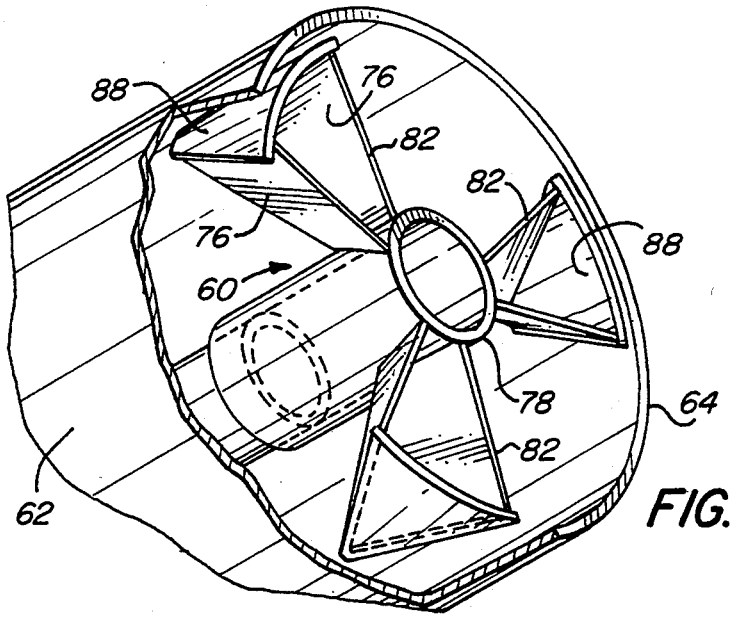
FIG. 11 is a perspective broken-away view of the fuel feed tube's discharge end with the solid fuel separator shown in FIG. 8.
Figure 10:
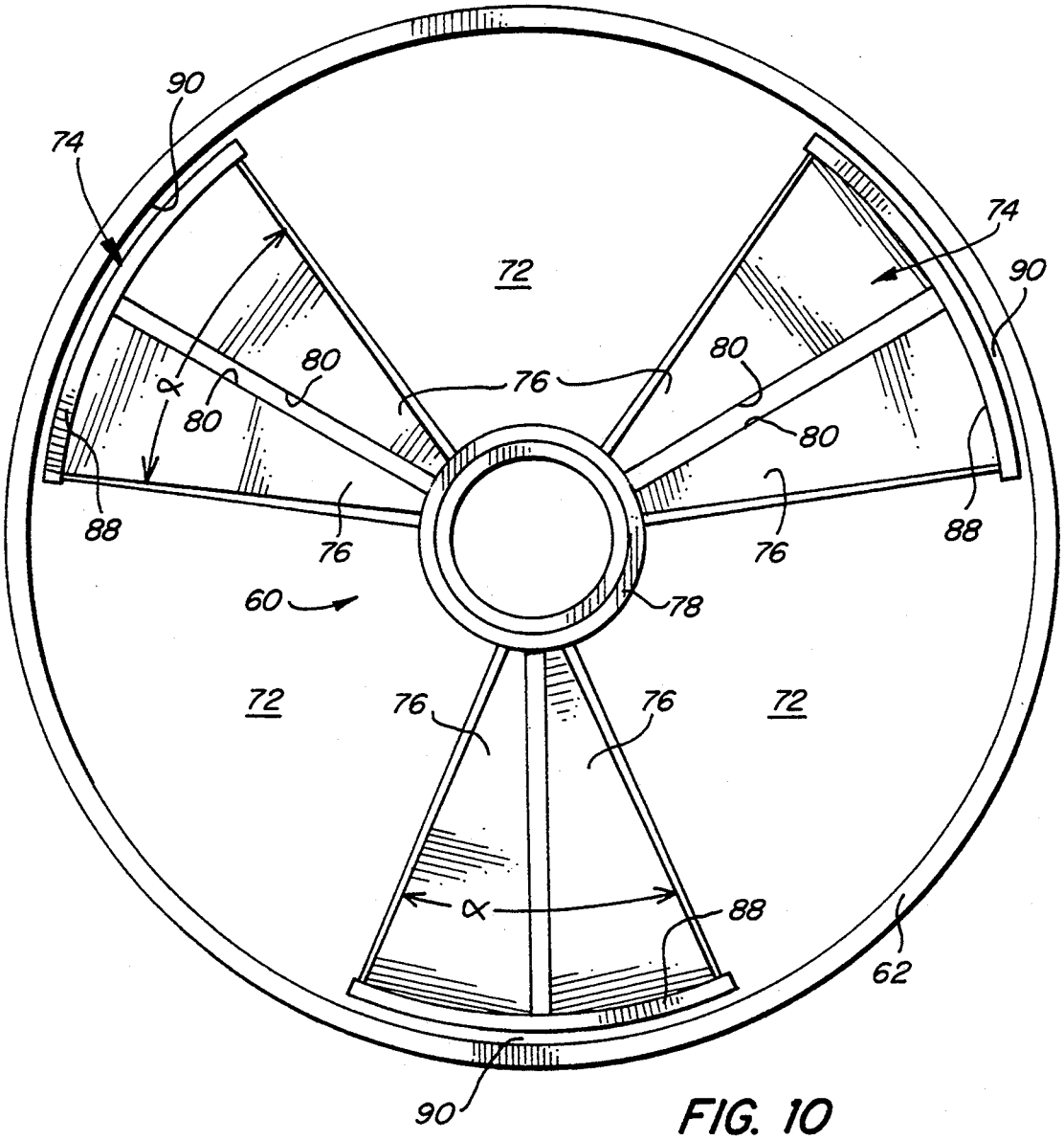
FIG. 10 is an enlarged downstream view in elevation of the circumferential solid fuel separator shown in FIG. 8.

As a result and illustrated in FIG. 6, downstream of the regions 24 and 26 are respectively fuel lean zones 28 and fuel rich zones 30, circumferentially-spaced around an ignition zone. Other techniques can be used to create circumferentially-spaced fuel lean and fuel rich zones 28, 30. For instance, the curvature of adjacent vanes can be controlled so that some drag or stall is introduced in the space between vanes. Or an obstruction can be placed in the path of the air stream. In each case, an air depletion zone and an air rich zone are produced downstream of the flame stabilizer 16.

The number of fuel rich/fuel lean zones 30, 28 can vary such as from two to five of each. However, at this time, three fuel rich and three fuel lean zones 30, 28 of the same angular span of about 60° are preferred.

An air staging ring 36 is located to extend radially outwardly from the periphery 28 of the vanes 22. The ring 36 serves to increase upstream air pressure and direct air towards the outer section of the burner throat to delay secondary air entry further downstream of the flame region. Ring 36 is apertured as described in the aforementioned '334 patent and copending patent application. However, the air mass flow past ring 36 is enhanced adjacent vane regions 24 by increasing the holes 38 in the ring 36 in comparison with those opposite van regions 26. Some or all of the holes 38 can be drilled at an angle relative to the burner axis 40 as illustrated at 42 in FIG. 4. This further disperses secondary air flow outwardly for delayed entry into the flame.

Figure 7:
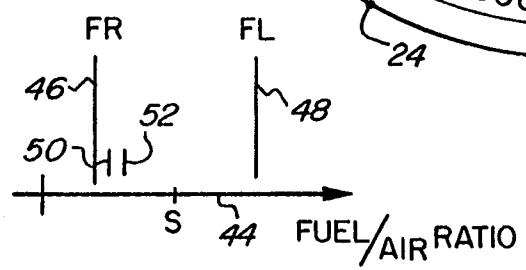
FIG. 7 is a simplified plot of flammability range for a burner as a function of fuel to air ratio.
Figure 4:
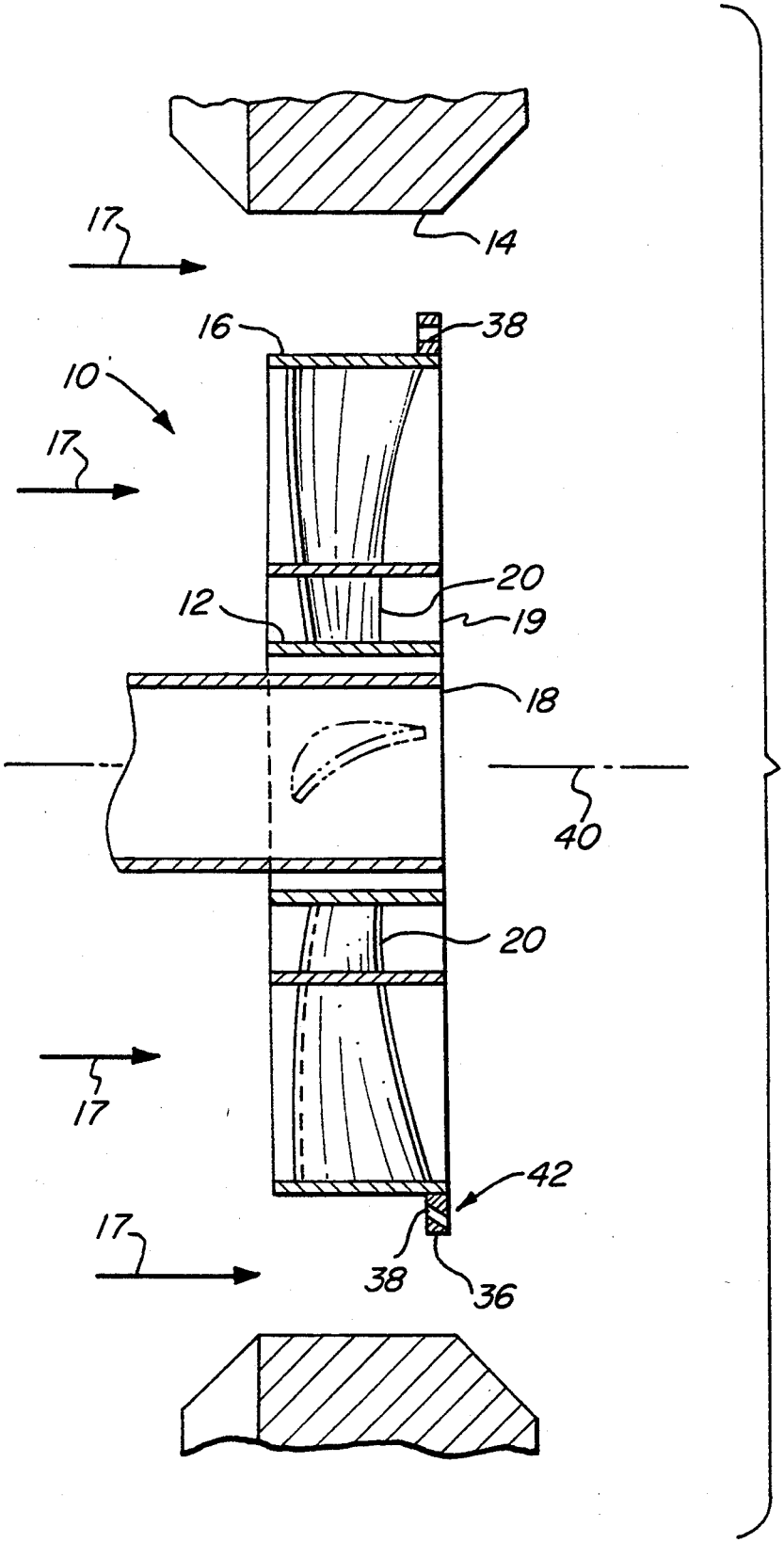
FIG. 4 is a side section view of a burner in accordance with the invention.

The amount of secondary air mass flow restriction in vane regions is limited so that the fuel rich zones 30 remain within desired flammability limits. FIG. 7 represents a fuel to air ratio dimension along the abscissa 44 and flammability limits 46, 48 for the fuel air ratio. S represents a stoichiometric ratio, line 46 a maximum fuel rich ratio, and line 48 a maximum fuel lean ratio. Lines 46, 48 define a flammability region.

The amount of secondary air mass flow reduction or the number of extra vanes 20 inserted or the entrance and exit angles of the vanes can be selected to accomplish that at regions 26 is so selected that the fuel to air ratio in the fuel rich zones 30 lies in the flammability range defined by the fuel rich and fuel lean lines 46, 48 and preferably is in the range from about 80% to about 95% of the lower flammability limit line 46 as suggested by lines 50, 52.

With reference to FIGS. 8–11, a fuel flow controller is shown in the form of a solid fuel separator 60 is shown mounted within a solid fuel feed tube 62. The discharge end 64 of the tube 62 has a flame stabilizer such as 16 mounted within the throat 66 of the burner and supported by the outer surface 68 of tube 62. The flow of solid fuel, such as coal particles through tube 62 without the separator 60, tends to distribute itself non-uniformly with a predominant portion towards the wall of the tube 62. As a result, the entry of the solid fuel into a recirculation zone anchored by flame stabilizer 16 is shifted away from the center of the zone and the dwell time of coal particles within the zone is reduced.

With the solid fuel separator 60 in accordance with the invention, the solid fuel flow is separated into circumferentially-spaced fuel rich zones 72 and fuel lean zones 74 and the solid fuel is deflected to some extent towards the center of the fuel feed tube 62.

The solid fuel separator as illustrated in the FIGS. 8–11 is formed by a plurality of radially-extending diverter vanes 76 welded to the end of a central support 78. The vanes 76 are arranged in pairs and so oriented that upstream-located edges 80 in a pair converge while their downstream-located edges 82 diverge. The vanes 76 further are so shaped and oriented that upstream edges 80 are inclined and the vanes can deflect a solid fuel stream that is intercepted by the vanes towards a more central region and a fuel rich zone 72 in the fuel feed tube 62. The radially outer ends 86 of vanes 76 are capped by outwardly-curved plates 88 welded to vanes 76. The vanes 76 are so shaped that the upstream edges 80 are inclined with their radially outer ends extended upstream, and the vanes are preferably so inclined circumferentially so as to provide a radially inward deflection of the peripheral coal flow.

The divergence angle alpha, $\alpha$, of downstream edges 82 and the number of pairs of vanes 76 primarily determines the amount of solid fuel that is diverted and deflected towards the fuel rich zones 72. The angular span that is selected is commensurate with the desired amount of additional fuel in the fuel rich zones 72. Generally, when three pairs of vanes 72 are employed, a circumferential span for a single pair of vanes in the range from about 20° to about 60° is sufficient. When the number of vane pairs is increased, then the circumferential span angle may be correspondingly reduced. For three pairs of vanes 76, three fuel lean zones of about 45° angular span can be effective.

The circumferential orientation of the solid fuel diverter is further preferentially selected when a flame stabilizer 16, such as shown and described with reference to FIGS. 1–6, is used. In such case, the fuel rich zones 72 are preferably circumferentially-aligned with the restricted regions 26 (air depletion zones) of the flame stabilizer 16. Variations of this type of circumferential alignment can be made to accommodate flow variations and optimize $NO_x$ reductions. The effectiveness of the solid fuel diverter can be observed by rotating it relative to the flame stabilizer 10 and monitoring the $NO_x$ levels. A variation of 10% to 15% can be noticed.

The radial lengths of the vanes 76 and their end caps 88 are selected so as to preferably extend close to the wall of feed tube 62, so as to intersect most of the solid fuel flow incident along the circumferential span angle. A small gap, 90, however, is left to enable some solid fuel and air to reach the zone otherwise masked by the vane pairs and enable axial positioning of the fuel flow separator 60.

With reference to FIGS. 12–16, a different solid fuel flow separator 100 in accordance with the invention is shown for installation inside a fuel feed tube 62 whose discharge end 64 has a converging lip 101. The fuel flow separator 100 is formed of solid fuel deflectors 102 that are welded to radially extending struts 104 welded in turn to a central elongate tubular support 106.

The deflectors 102 are oriented in an inclined manner relative to the axial flow as represented by arrow 108 so that some of the peripherally-located solid fuel is intercepted and deflected towards a more central region of fuel feed tube 62 near its discharge end 64. The deflectors 102 are formed of vanes 110 arranged in pairs such as 110.1 and 110.2 and can be made of a single heavy metal plate that is bent along a fold line 112 or of separate joined vane plates which are welded together along line 112 or made of a single curved plate.

Figures 12, 13, 14, 15:
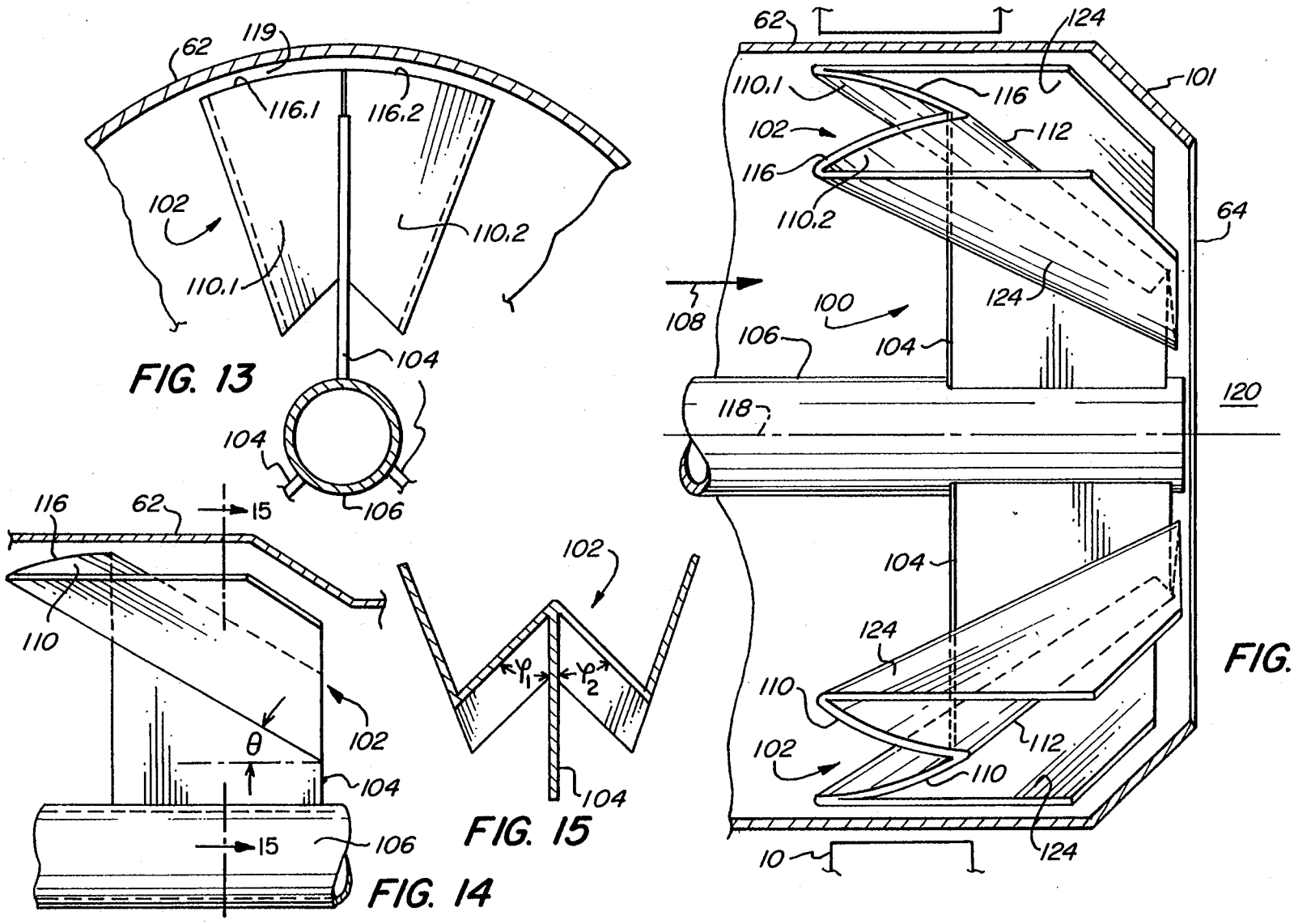
FIG. 12 is a side perspective view of another coal flow separator in accordance with the invention.
FIG. 13 is a partial end view of the coal flow separator shown in FIG. 12.
FIG. 14 is a broken-away side view of the coal flow separator of FIG. 12.
FIG. 15 is a partial axial sectional view of the coal separator shown in FIG. 12.
Figure 16:
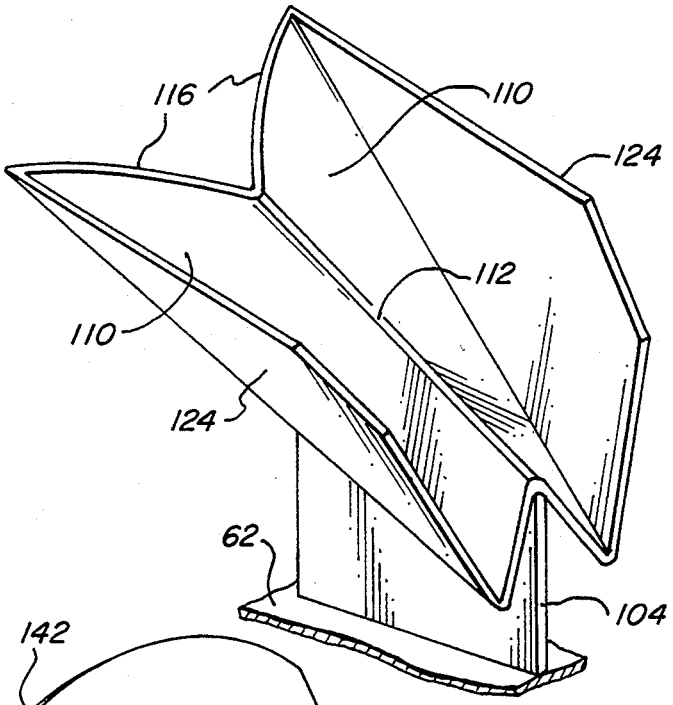
FIG. 16 is a different partial perspective view of the solid fuel flow separator as shown in FIG. 12.

The vanes 110 are shown preferably as flat plates, but could be curved, and have radially upper edges 116 curved to match the internal curvature of fuel feed tube 62. Vanes 110 are inclined along planes which intersect the central axis of fuel feed tube 62 and form an angle $\theta$ with respect to the axis 118 within an axial plane as represented by the view of FIG. 14. Vanes 110 are further so inclined as to form angles $\Psi_1$ and $\Psi_2$ with respect to a radial plane or strut 104 as shown in FIG. 15. The gap 119 between upper edges 116.1 and 116.2 of vanes 110 is made sufficiently small so as to obstruct solid fuel flow while providing sufficient clearance to move the separator 102 into the desired position.

Vanes 110 further have fanned shapes as shown in the view of FIG. 13 so that a vane pair 110.1 and 110.2 circumferentially expand towards the periphery of fuel feed tube 62. Vane pairs, therefore, form a radially, inwardly-directed grooved funnel with which peripherally-located solid fuel can be intercepted and directed towards the central region 120 of discharge end 64 while providing a fuel lean region downstream of the vanes 110.

The solid fuel diverters 102 are as shown in FIG. 12 further provided with metal side skirts 124, 126 located at circumferential ends. The shirts are welded to vanes 116 and extend generally radially outwardly to the inner surface of fuel feed tube 62 to thus further enhance the marking of fuel by vanes 110 and assure fuel lean zones downstream of the vanes.

The number of diverters 102 employed is commensurate with the number of fuel lean zones or, air "rich" zones, 24 of a flame stabilizer 10. In the event the flame stabilizer 10 has no circumferential air rich and air depletion producing zones 24, 26, the number of diverters can be three or four depending upon their circumferential sizes.

Generally, the angular span of diverters 102 is of the order of between about 20° to about 60°. For three diverters 102 spaced at equal angles of 120°, a diverter 102 angular span of 45° can be effective to cause a substantial reduction of $NO_x$.

The inclination angle $\theta$ for diverters vanes 110 can be varied. The angle preferably is of the order of about 30°, though angles in the range from about 15° to about 75° appear possible. With smaller angles $\theta$, the diverters' axial length increases resulting in a greater expense. At higher angles, the smooth flow of the solid fuel and air inside the tube 62 is disrupted. The extent to which diverters 102 approach the central region of fuel feed tube 62 is selected so as not to choke off solid fuel flow while still providing sufficient diversion of solid fuel to fuel rich zones.

Figure 17:
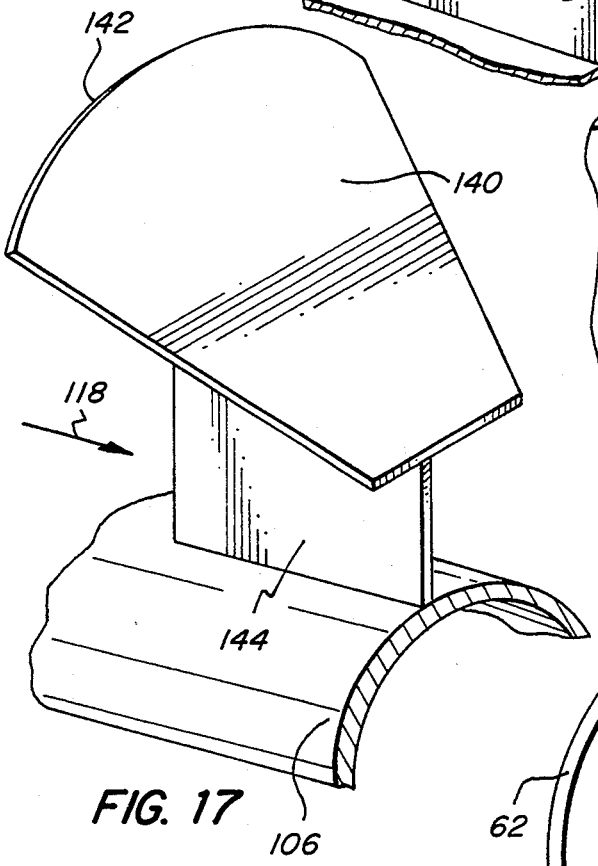
FIG. 17 is a partial perspective view of still another solid fuel flow separator in accordance with the invention.
Figure 18:
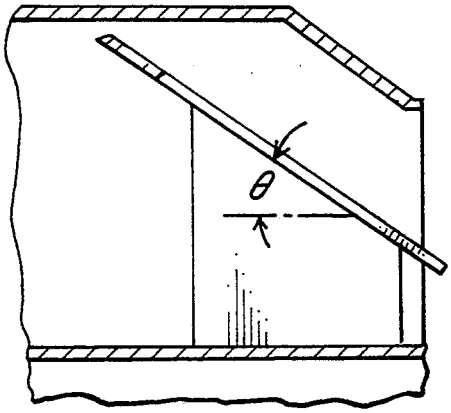
FIG. 18 is a partial side view in elevation of the solid fuel flow separator of FIG. 17.
Figure 19:
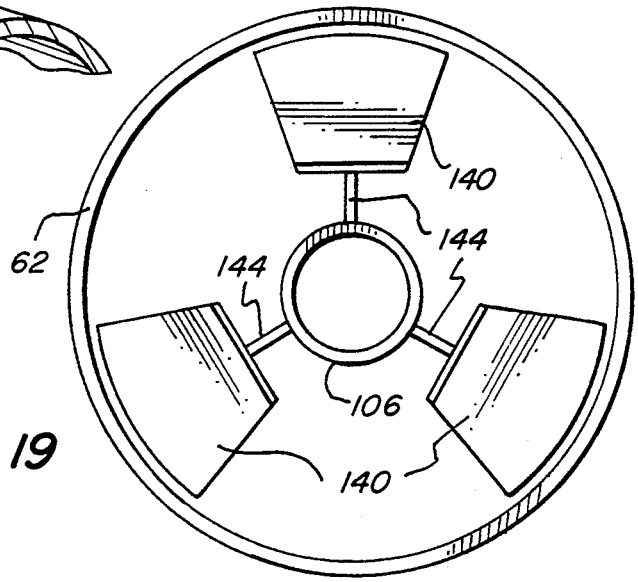
FIG. 19 is an end view of the solid fuel flow separator of FIG. 17.

With reference to FIGS. 17–19, still another solid fuel flow separator 140 is shown formed of a solid, inclined, generally flat plate. The upper edge 142 is curved to fit close to the inner surface of a fuel feed tube 62 and a strut 144 is welded to plate 140 and support tube 106. Three angularly-spaced inclined plates 140 are used, though more and smaller ones can be employed.

Having thus described one form of the invention, its advantages can be appreciated. Variations can be made by one skilled in the art without departing from the scope of the invention. For example, other techniques can be used to create circumferential fuel rich and fuel lean zones within the flammability region and preserving the desired swirl number for the burner.

What is claimed is:

1. A burner of solid fuel comprising:

a fuel feed terminating at a discharge end to provide fuel to a flame ignition zone that is downstream from the discharge end; and a flame stabilizer placed around the fuel feed to intercept secondary air flow, said flame stabilizer having a plurality of radially extending secondary air deflecting vanes shaped to maintain a stabilized vortex downstream of the discharge end to anchor the flame ignition zone;

said flame stabilizer including means for producing a plurality of angularly spaced secondary air flow restricting regions separated from angularly spaced less restrictive secondary air flow regions to respectively produce multiple, circumferentially-alternating fuel rich and fuel lean zones downstream of said flame stabilizer for a reduction of $NO_x$.

2. The burner as claimed in claim 1 wherein said means for producing angularly spaced secondary air flow restricting regions restrict mass flow in said fuel rich zones such that their fuel to air ratios are generally in the range from about 80% to about 95% of the lower flammability limit applicable to the fuel and primary air supplied by the burner.

3. The burner as claimed in claim 1 wherein said flame stabilizer's plurality of angularly spaced secondary air flow restricting regions and angularly spaced less restrictive secondary air flow regions comprise a plurality of vanes with the vanes in said secondary air flow restrictive regions being more closely spaced than in said less restrictive secondary air flow regions.

4. A controller for use with burners of fuel supplied through a generally central fuel feed with primary air to emerge from a discharge end of the fuel feed to produce a flame ignition zone downstream from the discharge end with secondary airflow being supplied around the fuel feed to the flame ignition zone, comprising:

a flame stabilizer shaped to fit around the fuel feed to intercept secondary air flow and having a plurality of radially-extending air deflecting vanes, said vanes being shaped to maintain a stabilized vortex downstream of the discharge end to anchor the flame ignition zone downstream thereof;

said vanes being circumferentially-spaced around the fuel feed, with selected circumferential segments of the flame stabilizer having a greater density of vanes than other angularly adjacent circumferential segments so as to produce downstream from said fuel feed a multiple of circumferentially-spaced fuel rich zones which are angularly separated by fuel lean zones.

5. A method for reducing the generation of $NO_x$ from burner operations comprising the steps of:

generating a central flow of fuel and air in a downstream direction;

producing a vortex with secondary air flow to anchor a flame ignition zone at a desired downstream position;

varying the mass flow of secondary air flow at a multiple of predetermined circumferential locations so as to produce a corresponding multiple of circumferentially-alternating fuel rich and fuel lean zones around the flame ignition zone.

6. The method as claimed in claim 5 wherein the step of varying the secondary air flow comprises the step of restricting the mass flow of secondary air at circumferentially spaced regions.

7. A fuel flow controller for a burner of solid fuel comprising:

a fuel feed tube terminating at a discharge end to provide fuel to a flame ignition zone that is downstream from the discharge end;

a circumferential fuel flow separator placed within said fuel feed tube; said fuel flow separator being formed of a plurality of diverters circumferentially-spaced around a central axis of the fuel feed tube, said diverters having vanes oriented to divert axially moving solid fuel into circumferentially-spaced fuel rich zones separated by circumferentially-spaced fuel lean zones downstream of the diverters.

8. The fuel flow controller for a burner of solid fuel as claimed in claim 7 wherein said diverters include a support member generally centrally-located within the fuel feed tube and terminating in the vicinity of said discharge end and further including pairs of vanes mounted to the support member, the vanes in a pair being oriented to converge towards each other in an upstream direction and diverge from each other in a downstream direction so as to circumferentially deflect fuel flow moving downstream to the discharge end to form adjacent fuel rich zones and a fuel lean zone that is downstream of the plates.

9. The fuel flow controller for a burner of solid fuel as claimed in claim 7 wherein portions of said vanes diverge so as to span a circumferential angle that is in the range from about 20° to about 60°.

10. The fuel flow controller for a burner of solid fuel as claimed in claim 9 wherein the circumferential angle is generally about 45°.

11. The fuel flow controller for a burner of solid fuel as claimed in claim 7 and further including:

flame stabilizer means placed to fit around the fuel feed tube to intercept secondary air flow and having a plurality of radially-extending air deflecting vanes, said latter vanes being shaped to maintain a stabilized vortex downstream of the discharge end to anchor the flame ignition zone;

said flame stabilizing means including means for circumferentially restricting and passing the mass flow of secondary air at respective predetermined circumferential regions located so as to produce circumferentially-alternating fuel rich and fuel lean zones that are in a desired circumferential alignment with the circumferentially-spaced fuel rich and fuel lean zones produced by said fuel flow separator so as to reduce $NO_x$ generated by the burner.

12. The fuel flow controller for a burner of solid fuel as claimed in claim 11 wherein the fuel flow separator is so oriented that the circumferentially-spaced fuel rich and fuel lean zones are in general respective circumferential alignment with fuel rich and fuel lean zones produced by said flame stabilizer means.

13. The fuel flow controller for a burner of solid fuel as claimed in claim 7 wherein said vanes comprise angularly spaced, substantially flat plates inclined relative to the fuel feed tube so as to intercept peripherally-located solid fuel flow and deflect said intercepted fuel flow towards a central region of the fuel feed tube near its discharge end.

14. The fuel flow controller for a burner of solid fuel as claimed in claim 7 wherein said vanes are arranged in joined pairs and are each inclined to deflect peripherally-located fuel flow both circumferentially and towards a central region of the fuel feed tube.

15. The fuel flow controller for a burner of solid fuel as claimed in claim 14 wherein joined pairs of vanes form a converging groove oriented to direct intercepted solid fuel flow towards the central region of the fuel feed tube.

16. The fuel flow controller for a burner of solid fuel as claimed in claim 13 wherein said vanes have an inclination angle as measured in an axial plane is in the range from about 15° to about 75°.

17. The fuel flow controller for a burner of solid fuel as claimed in claim 16 wherein said inclination angle is about 30°.

18. A method for reducing the generation of $NO_x$ from burner operations comprising the steps of:

generating a central flow of solid fuel and air in a downstream direction;

producing a vortex with secondary air flow to anchor a flame ignition zone at a desired downstream position;

varying the flow of solid fuel at predetermined circumferential locations so as to produce circumferentially-alternating fuel rich and fuel lean zones around the flame ignition zone.

19. The method as claimed in claim 18 and further comprising the step of varying the secondary air flow at circumferentially spaced regions so as to produce circumferentially spaced air rich and air poor regions.

20. The method as claimed in claim 18 and further including the step of:

varying the mass flow of secondary air at predetermined circumferential locations so as to produce circumferentially-alternating fuel rich and fuel lean zones which are in respective general alignment with the circumferential fuel rich and fuel lean zones produced by varying the solid fuel flow.

21. A method for reducing the generation of $NO_x$ from burner operations comprising the steps of:

generating a flow of fuel and air in a downstream direction;

producing a vortex with secondary air flow to anchor a flame ignition zone at a desired downstream position;

varying the flow of fuel at predetermined circumferential locations so as to produce circumferentially spaced fuel rich and fuel lean zones;

varying the mass flow of secondary air at preselected circumferentially spaced locations so as to produce circumferentially spaced air rich and air lean zones; and setting the circumferential alignment of the fuel rich and fuel lean zones with respect to the air rich and air lean zones for a reduction of $NO_x$ from the burner.

22. The method for reducing $NO_x$ from a burner as claimed in claim 21 wherein the setting step comprises circumferentially aligning the air rich and air lean zones respectively with the fuel lean and fuel rich zones.

23. In a low $NO_x$ fuel burner wherein a fuel is supplied to a flame ignition zone, the improvement comprising:

a flame stabilizer placed to intercept secondary air flow, said flame stabilizer having a plurality of radially extending secondary air deflecting vanes shaped to maintain a stabilized vortex to anchor the flame ignition zone;

said flame stabilizer including a plurality of angularly spaced secondary air flow restricting regions separated from angularly spaced less restrictive secondary air flow regions to respectively produce multiple, circumferentially-alternating air lean and air rich zones downstream of said flame stabilizer; and a fuel diverter interposed in the path of the fuel flow to separate the fuel flow into circumferentially alternating fuel rich and fuel lean zones downstream of said fuel diverter and said flame stabilizer;

said fuel diverter and said flame stabilizer being so circumferentially oriented so as to overlap the fuel rich and lean zones and air rich and lean zones in a manner selected for a substantial reduction of thermal $NO_x$ from the burner.

24. The improved fuel burner as claimed in claim 23 wherein the flame stabilizer has the same number of secondary air flow restricting regions and less restrictive secondary air flow regions as the number of fuel rich and fuel lean zones.

25. The improved fuel burner as claimed in claim 23 wherein the flame stabilizer and fuel diverter are so circumferentially oriented with respect to each other that the fuel rich zones circumferentially align with air lean zones and the fuel lean zones circumferentially align with air rich zones.

* * * * *